United States Patent [19]

Diggle, Jr. et al.

[11] 4,247,969

[45] Feb. 3, 1981

[54] METHOD FOR MOISTURE CONDITIONING OF COMPRESSIVELY TREATED FABRIC

[75] Inventors: Edmund A. Diggle, Jr., Oradell; Paul Moser, Harrington Park, both of N.J.

[73] Assignee: Compax Corporation, Woodside, N.Y.

[21] Appl. No.: 10,495

[22] Filed: Feb. 8, 1979

Related U.S. Application Data

[63] Continuation of Ser. No. 843,725, Oct. 19, 1977, abandoned.

[51] Int. Cl.[3] ..... D06C 21/00

[52] U.S. Cl. ..... 26/18.6

[58] Field of Search ..... 26/18.6; 68/5 D

[56] References Cited

U.S. PATENT DOCUMENTS

| | | | |
|---|---|---|---|
| 1,861,423 | 5/1932 | Cluett | 26/18.6 |
| 2,362,309 | 11/1944 | Ross | 68/5 D |
| 2,721,370 | 10/1955 | Cluett et al. | 26/18.6 |
| 2,885,763 | 5/1959 | Schreiner | 26/18.6 |
| 3,015,146 | 1/1962 | Cohn et al. | 26/18.6 |
| 3,083,435 | 4/1963 | Cohn et al. | 26/18.6 |
| 3,088,224 | 5/1963 | Cohn et al. | 68/5 D X |
| 3,226,796 | 1/1966 | Fox et al. . | |
| 3,471,907 | 10/1969 | Beckers | 26/18.6 |
| 3,668,905 | 6/1972 | Schlunke | 68/5 D |
| 3,691,600 | 9/1972 | Joy | 26/18.6 |
| 3,694,870 | 10/1972 | Fischer | 26/18.6 |
| 4,010,522 | 3/1977 | Stanislaw | 26/18.6 |
| 4,031,596 | 6/1977 | Joy | 26/18.6 |
| 4,058,874 | 11/1977 | Hausner | 26/18.6 X |

FOREIGN PATENT DOCUMENTS

| | | | |
|---|---|---|---|
| 2242504 | 3/1975 | France . | |
| 453187 | 9/1936 | United Kingdom | 26/18.6 |
| 1446812 | 8/1976 | United Kingdom . | |

OTHER PUBLICATIONS

*FRL Compactor Machine Settings and Operation*, Fabric Research Laboratories, Inc. 17 pages undated.

*Controls for Loop Heights; Hopper Levels & Fill Heights*, Martech, Parlin, N.J. undated.

*New Continuous Position Sensor and Control Device Aids High Speed Production In Textiles, Paper, Rubber and Sheet Metal Industries*, QSS-9100 Position Sensor System, Quantum Sensing, Inc., Bohemia, N.Y. 8/29/1975.

*Primary Examiner*—Robert Mackey

*Attorney, Agent, or Firm*—Mandeville and Schweitzer

[57] ABSTRACT

The disclosure relates to a finishing treatment for fabrics, either tubular or knitted, having at least some natural fiber content, where the fabrics have been given a compressive shrinkage treatment by an asymmetrical process, sometimes referred to herein as "burnish compacting", in which one side of the fabric is acted upon differently than the other. The process of the invention eliminate or minimize "two sidedness" in the appearance of the fabric, which otherwise can be particularly noticeable with respect to colored fabrics. After passing through an asymmetrical compressive shrinkage process, the fabric is conveyed in a tension free manner through a moisturizing station, in which moisture is sprayed on the opposite surfaces of the fabric in the form of an extremely fine fog or mist, in quantities greater than the natural moisture regain of the fabric after compacting. The thus-moisturized fabric immediately enters a so-called Palmer-type dryer, in which the fabric is held against a steam-heated drum by means of a porous blanket. Significant improvement in the opposite side uniformity of the fabric is obtainable by the process.

16 Claims, 8 Drawing Figures

METHOD FOR MOISTURE CONDITIONING OF COMPRESSIVELY TREATED FABRIC

This is a continuation of application Ser. No. 843,725, filed Oct. 19, 1977, abandoned.

BACKGROUND AND SUMMARY OF THE INVENTION

In the processing of many fabrics, particularly knitted fabrics in either tubular or flat form, many of the significant commercial finishing techniques involve the application of lengthwise mechanical compressive shrinkage to the fabric by processes which may be regarded as asymetrical, in that one side of the fabric is acted upon at least somewhat differently than the other side. By way of example, one of the important commercial processes for the compressive shrinkage of tubular knitted fabric, the "Compax" process, involves directing the fabric into a compacting zone formed in part by feeding and retarding rollers rotating at slightly different speeds. The fabric is being introduced into the zone at the speed of the feeding roll and is being decelerated in the treating zone to the speed of the retarding roll. As the fabric passes between these two rollers, it is being acted upon simultaneously by rollers moving at different surface speeds, so that at least one of the rollers is moving relative to the fabric. One surface of the fabric thus may become slightly "burnished", so that it may appear slightly more shiny than the opposite surface. This is referred to as "two sidedness".

Typically, two sidedness resulting from asymmetrical compressive shrinkage treatment, sometimes herein called burnish compacting is more pronounced with colored fabrics, and of course may be more troublesome in connection with fabrics processed in tubular form, where one side of the fabric tube constitutes the same "surface" as the other side of the tube (e.g., both the top and the bottom surfaces of a fabric tube may constitute the outside surface of a garment).

In some cases, asymmetrical processing of the fabric is at least partially compensated by treatment of the fabric in two stages, such that any burnishing action is applied to one surface in the first stage and to the opposite surface in the second stage. By appropriately proportioning the amount of compressive shrinkage effort applied at the respective stations, it may be possible to substantially balance the surface appearance of the fabric. Nevertheless, even using a two station machine, some two sidedness may result, either because it is not practical to balance it out altogether, or because the desired proportioning of effort in order to achieve balance of appearance may not be consistent with optimum balance of effort for achieving the desired total compressive shrinkage effort. Moreover, in some cases the fabric itself (e.g., ribbed fabrics) may be of a nature such that its appearance can be changed undesirably during compressive shrinkage treatment, as by reason of the thickness compression of the fabric, as well as any burnishing action.

In accordance with the invention, two sidedness and other undesired effects in mechanically compressively shrunk fabric may be greatly improved by a new moisturizing treatment, in which significant amounts of moisture are imparted with great uniformity of distribution to the opposite surfaces of the fabric, following compressive shrinkage treatment, after which the fabric is immediately directed into a Palmer-type dryer, in which the fabric is held in a geometrically stabilized condition against the heated surface of a dryer drum, by means of a porous conveyor blanket. Upon emergence from the discharge end of the Palmer-type dryer, the fabric is in a finished condition, with significantly improved surface appearance, both from the standpoint of two sidedness and/or thickness compression (as in the case of a ribbed fabric).

In accordance with the invention, moisture is applied to the opposite sides or surfaces of the fabric in an extremely finely divided spray mist or fog, under conditions that reliably avoid the formation of droplets, which might spot or mark the fabric. The amount of moisture to be applied to the surface of the fabric is somewhat empirical for different fabrics, but in any event is greater than that which could possibly be achieved by either steaming of the fabric or by natural moisture regain. In this respect, steaming of the fabric may add approximately two percent or so moisture by weight, whereas natural moisture regain with time may add about six percent. In contrast, in some cases, with light fabrics subjected to substantial compressive shrinkage treatment, it might be appropriate in the process of the invention to add surface moisture constituting up to fifty percent by weight of the fabric.

Pursuant to one aspect of the invention, the rate of moisture application to the fabric, for a given speed of travel of the fabric, is set such that the fabric will have been adequately dried by the time it emerges from the Palmer-type dryer. The spray mist application is set to be applied at a constant rate, and the amount applied to the fabric therefore will vary as a function of the speed of travel of the fabric through the misting zone. An operator of the process observes the fabric emerging from the Palmer-type dryer, and the process can be progressively speeded up until the emerging fabric evidences undesirable two sidedness, after which the processing speed may be slowed down slightly, so that a greater amount of moisture is applied to the fabric as it travels to the misting zone. Experience with the process indicates that restoration of the desired surface appearance of the fabric is to a great extent a function of the amount of moisture applied to the surface of the fabric, such that, once a constant rate of spray application has been established, excellent control over the process may be achieved by simply controlling the speed of travel of the fabric through the spraying-drying sequence. The spraying and the drying at all times remain in balance, because whenever the fabric speed is reduced to enable more moisture to be applied, its speed of passage through the dryer is correspondingly reduced, and vice versa, so that the drying effort is at all times consistent with the amount of moisture application.

In accordance with other aspects of the invention, an improved apparatus arrangement is provided for the uniform application of spray mist to the opposite surfaces of a moving fabric web, so that highly controlled amounts of moisture may be applied to opposite sides of the fabric, with consistent reliability, free of condensation spots or the like. It will be understood, of course, that the opposite "sides" of a tubular fabric will be the same surface. Thus, wherever reference is made herein to opposite sides or opposite surfaces of a fabric, such reference will be understood to mean the outside surface of a tubular fabric or the two surfaces of an open width fabric, as the case may be.

Pursuant to the invention, the fabric is conveyed in a completely tension free manner between opposed banks of spray nozzles, directed at the respective opposite surfaces of the fabric. Each bank of nozzles consists of a series of relatively closely spaced fine-atomizing spray nozzles extending across the full width of the fabric and arranged to discharge an air-atomized fine mist of moisture on the fabric surface. To accommodate the inevitable starting and stopping of the process from time to time during otherwise continuous production runs, means are provided for muffling the spray discharge of the nozzles during stoppage of the processing line, so that the nozzles do not have to be turned off. In this respect, stopping and starting of the air-atomizing nozzles may be occasioned by momentary sputtering and discharge of larger-than-desired droplets of moisture, which could otherwise spot the fabric.

For a more complete understanding of the above and other features and advantages of the invention, reference should be made to the following detailed description of a preferred embodiment and to the accompanying drawings.

DESCRIPTION OF A PREFERRED EMBODIMENT

Figure 1:
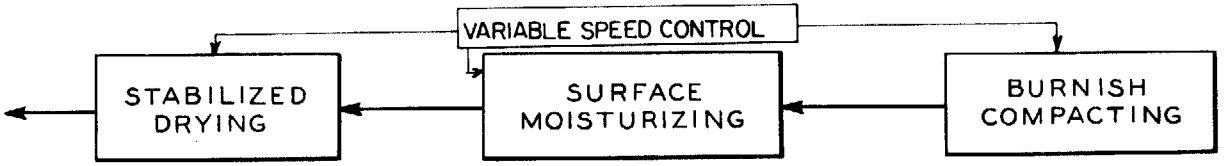
FIG. 1 is a box flow diagram of the fundamental steps involved in the process of the invention.

Referring now to the drawings, the schematic flow diagram of FIG. 1 indicates the basic steps involved in the process of the invention. First, there is the asymmetrical mechanical compressive shrinkage procedure which, for the purposes of this application, may be referred to as "burnish compacting". The term "burnish compacting" is intended to encompass various forms of compressive shrinkage treatment, whether or not performed in two or more stages, in which, in any one stage, the fabric is treated differently on one surface than on the other. Typically, this results in a rubbing action on one surface of the fabric, giving a slight polishing or burnishing effect. Commercially significant examples of burnish compacting procedures are reflected generally in the Eugene Cohn et al. U.S. Pat. No. 3,015,145, No. 3,083,435 and No. 3,015,146. Other processes, such as that reflected in the Walton U.S. Pat. No. 3,260,778 and Walton et al. U.S. Pat. No. 3,869,768, will impart differential action to the opposite surfaces of a fabric and would thus constitute burnish compacting within the meaning of that term as used in this application. In general, the term "burnish compacting" is intended to cover rather broadly processes for the compressive shrinkage of fabrics, in either tubular or flat form, and either of knitted or other construction, in which one of the surfaces of the fabric is affected differently than the other, either because of differential action in the compressive shrinkage equipment itself, or because of the fabric construction.

The terms "surface moisturizing" as referred to in the flow diagram of FIG. 1, refers to the application of a fine fog or mist spray to the surface of the fabric on an extremely finely divided, highly uniform basis. The term "stabilized drying" refers generally to drying of the moisturized fabric with heat, while maintaining the geometric stability of the fabric, as by the use of a Palmer-type dryer, for example, as distinguished from an air jet dryer.

Figure 2A:
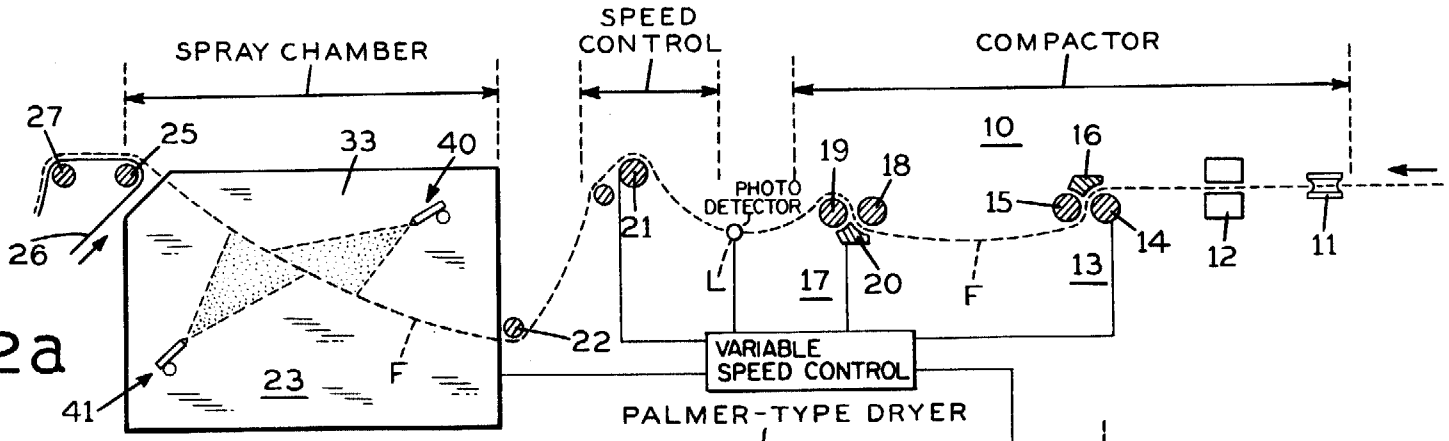
FIGS. 2*a* and 2*b* constitute a simplified representation of a processing line for carrying out the process of the invention.

With reference more particularly to FIG. 2, the process of the invention includes a compactor stage 10 which, in the specifically illustrated example, may be generally in accordance with the Eugene Cohn et al. U.S. Pat. No. 3,015,146. To that end, the compactor includes a spreader stage 11 for receiving tubular knitted fabric and distending it laterally to a predetermined, uniform width. The thus distended fabric is passed through a steaming stage 12, and then is discharged directly into a compacting station 13, consisting of respective feeding and retarding rollers 14, 15, and a confining shoe 16. The fabric enters the compacting station substantially at the surface speed of the feed roller 14. However, as it encounters the retarding roller 15, at a pressure nip formed by the respective opposed rollers 14, 15, the retarding roller exerts a superior grip on the fabric, and its movement is retarded substantially to the speed of the retarding roller. In the region where the feeding and retarding rollers are directly opposed, the lower surface, in the case of the compacting station 13, is slightly burnished by the slipping action of the feed roller 14.

The fabric F, now partially compacted by the station 13, enters a second compacting station 17, which likewise consists of a feed roller 18, retarding roller 19 and confining shoe 20, in this case oriented upside down with respect to the previous station 13. The arrangement is such that the burnishing action of the second station feed roller 18 is applied to the upper surface of the fabric 16, whereas it is applied to the lower surface in the upstream station 13. In the absence of ideal results, rarely achieved in practice, the mechanically preshrunk fabric issuing from the second stage compacting station 17 may have some degree of two sidedness, meaning that one surface will appear to be different than the other. The two sidedness effect will, of course, be more pronounced where the burnish compacting is performed in a single station machine, as will be readily appreciated. Moreover, the effect, although physically probably no different, is more noticeable with colored fabrics than with white fabrics and is more noticeable with darker colors than with lighter colors.

In general, the burnishing effect resulting from burnish compacting of a fabric does not appear to result from a fundamental change in the structure of the fabric, but rather from a temporary change in its surface characteristics. In time, through normal use, washing, drying, handling, etc., such two sidedness probably would disappear. In the meantime, however, it represents a significant impediment to sale and use of the fabric, where there is a pronounced two-sided appearance.

In accordance with the present invention, fabric discharged from the burnish compacting stage, is conveyed over a speed control roller 21, including appropriate photoelectric detectors or the like, by which the speed of the burnish compacting operation is controlled automatically, in relation to the speed of the moisturizing and drying operations to be described, so as to maintain the fabric in a relaxed condition on the discharge side of the compactor. Typically, this is accomplished by detecting the limits of a loop L in the fabric, so that the speed of the compacting operation is increased as the loop diminishes and is decreased as the loop enlarges.

The roller 21, which may be referred to as the speed control roll, operates at the basic speed of operation of the line, including the moisturizing operation and the drying stage, and this speed is set by the process operator with a suitable variable speed control. Fabric leaving the discharge side of the roll 21 passes under a guide roll 22 and into the lower portion of a moisturizing chamber 23, through an appropriate opening 24 (FIG. 4) provided for that purpose. The fabric then travels in a generally upward course, at an angle of approximately 30° or 40° through the chamber. While passing through the moisturizing chamber 23, the fabric F, which is maintained in a relaxed, tension free condition and in a relatively quiescent state except for its forward motion, is sprayed on both surfaces with a fine fog or mist of water.

Figure 2B:
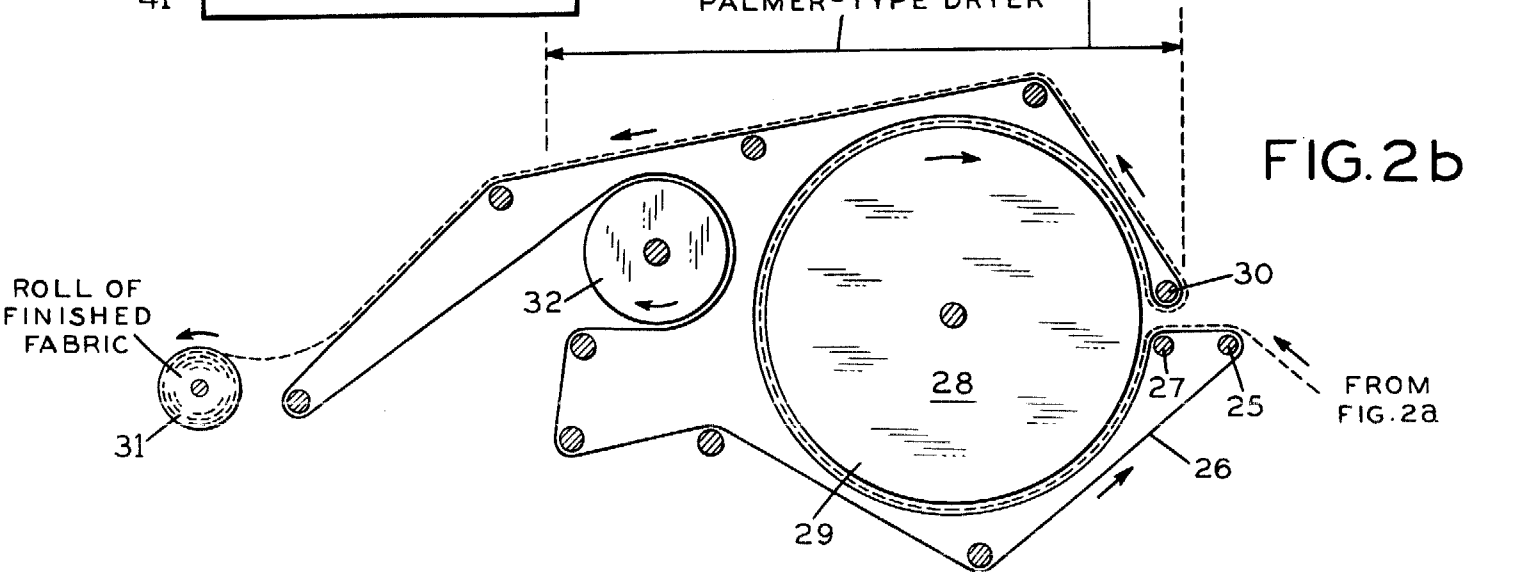

Immediately upon leaving the spray chamber 23, the moist fabric is supported and conveyed by a belt 26 of a Palmer-type dryer 28 (FIG. 2*b*). The belt 26 passes over guide rollers 25, 27 and carries the fabric into contact with the outer surface of a large diameter dryer drum 29, heated internally by steam to a temperature of, typically, about 150° C. In the illustrated arrangement, the dryer belt 26 is formed of relatively heavy, stable but porous material and is maintained under suitable tension. The belt thus presses the surface-moistened fabric firmly against the outer surface of the heated drum 29, while the belt and the drum travel together, along with the rotating drum. After passing completely around the drum, the belt 26 and fabric 16 pass around a guide roll 30, and the fabric is then conveyed by the belt to the rear of the dryer stage, where the fabric is gathered, either by winding into a finished roll 31 or by means of a suitable folder (not shown). After releasing the treated fabric, the dryer belt 26 passes about a second drum 32, which serves to drive off excess residual moisture from the belt, and the belt then returns back to the entry guide roll 25 to receive further incoming fabric.

As reflected in FIGS. 3–7, the moisturizing chamber 23 desirably consists of an open top tank 33, advantageously having side and end walls 34–37 and a bottom wall 38, but preferably with no top. A drain 39 is provided in the bottom to remove collected excess moisture. Upper and lower banks of nozzles 40, 41 are located in the tank, respectively above and below the path of the fabric 16 through the chamber. The banks of nozzles each consist of transversely disposed header pipes 43, 44 to which are physically mounted a series of atomizing nozzles 45, 46, arranged with flow passages of the nozzles communicating with the interior of the header pipes 43, 44.

Although the invention is not limited thereto, the spray nozzles 45, 46 may to advantage be "Sonicore" atomizing nozzles, as currently made available commercially by Sonic Development Corp., Upper Saddle River, New Jersey. These nozzles are air-atomizing water spray nozzles which, according to the manufacturer, are so designed that atomization of the water is enhanced by a sonic energy field. Typically, atomizing air is supplied to the nozzles through the manifold pipes 43, 44, and the nozzles are supplied individually with water, through individual supply lines (not shown) each of which may be adjusted by an individual regulator valve, such that uniform discharge and atomization of the water may be achieved across the entire bank of nozzles. In the illustrated apparatus, transverse nozzle spacing may be on the order of 7–8 cm, across the working width of the spray chamber 23, which may be slightly greater than the maximum width of fabric to be accommodated in the processing line.

Figures 3, 4, 5, 6, 7:
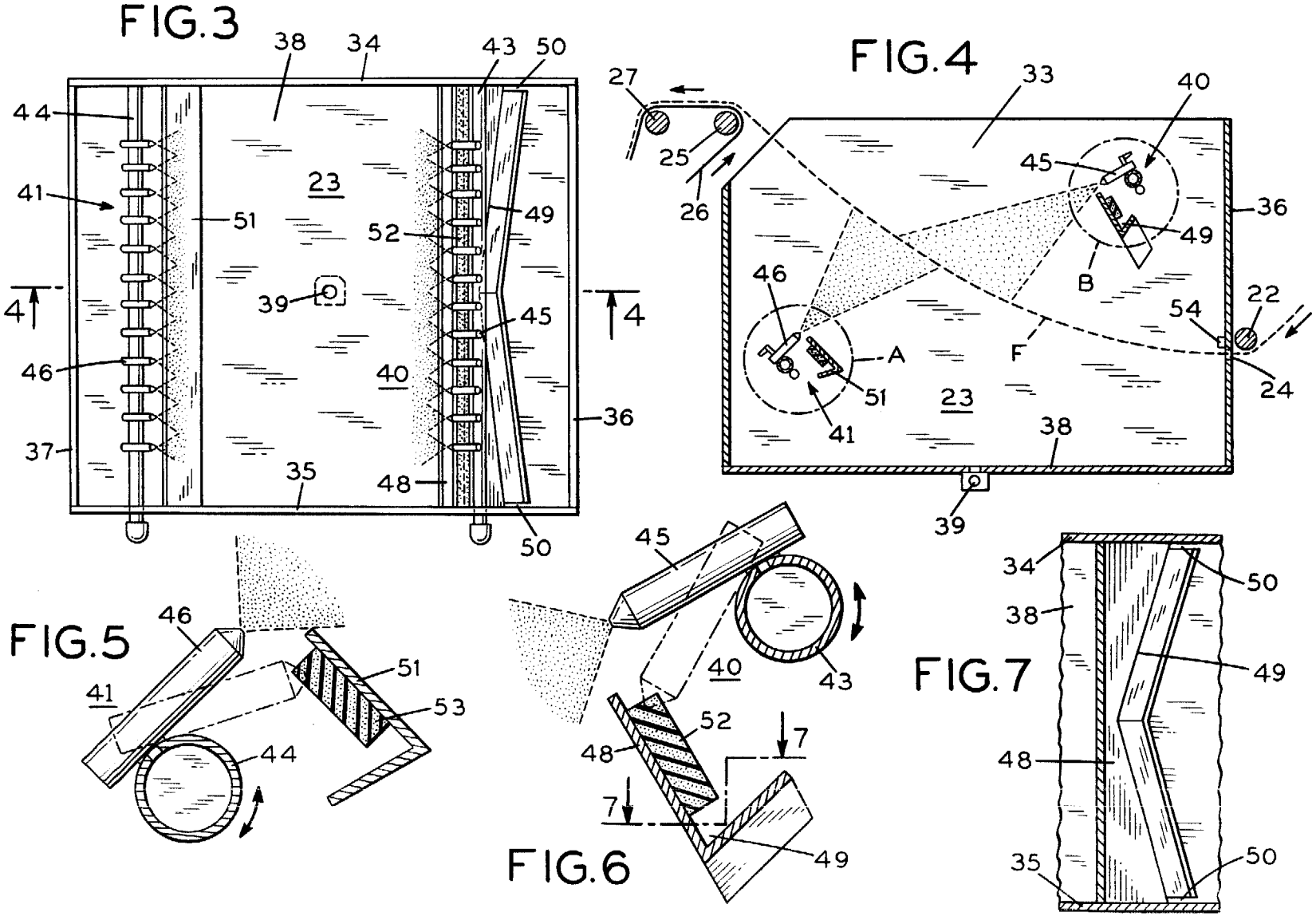
FIG. 3 is a top plan view illustrating an advantageous form of apparatus for the application of spray mist to the fabric surfaces in the quantities and with a uniformity consistent with the requirements of the process.
FIG. 4 is a cross sectional view as taken generally on line 4—4 of FIG. 3.
FIGS. 5 and 6 are enlarged, cross sectional views of the encircled areas A and B of FIG. 4.
FIG. 7 is a cross sectional view as taken generally on line 7—7 of FIG. 6.
Figure 8:
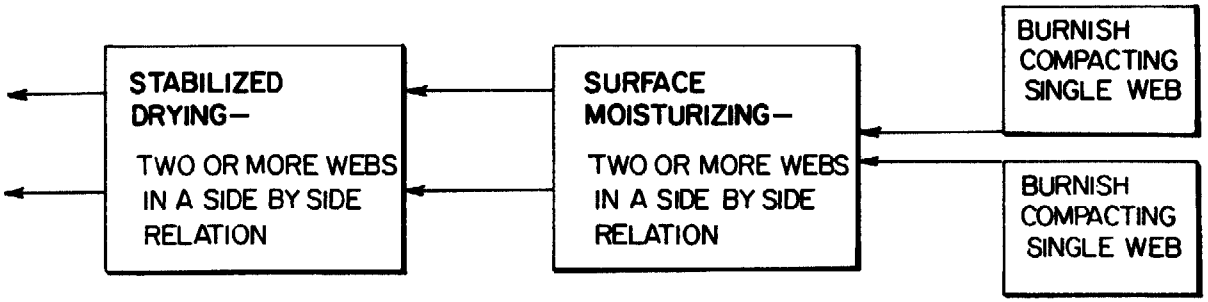
FIG. 8 is a block diagram illustrating the sequence of steps for moisture conditioning fabric webs in accordance with the present invention when applied to two webs processed in a side-by-side relation.

As reflected in FIG. 4, the upper bank 40 of spray nozzles is arranged to spray downward and to the rear, at an angle of 45° or so to the horizontal, while the lower nozzle bank is arranged to project upward and forwardly, at a generally similar angle. The adjustment of the nozzles, in terms of rate of flow, is typically such as to apply to the surfaces of the fabric a total of about two and a half ounces of moisture per square yard of fabric, when the fabric is advancing through the moisturizing chamber at a rate of approximately 14 meters per minute. When the nature of the fabric and/or the extent of the compressive shrinkage treatment enables satisfactory optimization of the fabric appearance with the application of a lesser amount of water, the advance of the fabric through the moisturizing-drying stages is speeded up, so that the fabric spends less time passing through the range of the misting nozzles, in which case correspondingly less moisture is applied.

A concomitant of speeding up the fabric movement, of course, is that the fabric spends less time on the dryer drum 28, and this is in fact desirable since there is less moisture on the fabric to be driven off. Speeding up or slowing down of the rate of fabric advance thus forms an ideal technique for control of the process, once a desirable balance is achieved between the time rate at which moisture is applied to the fabric and the capacity of the dryer 28 to remove that moisture. An operator at the discharge end of the dryer can simply inspect the fabric for possible two sidedness or other correctable condition, and continue to increase the rate of advance of the fabric, as long as the fabric appearance remains within specifiations. In some cases it may be possible to operate the process at speeds up to 36 meters per minute, using a relatively small Palmer-type dryer, processing light weight fabric which has been only moderately (e.g., 8%) compacted. In general, the capacity of the burnish compacting stage 10 is in all instances well in excess of the capacity of the dryer, such that there is no problem involved in controlling the compactor stage to respond appropriately to speed variations in the moisturizing-drying stage.

In the moisturizing stage, the amounts of moisture typically applied to the fabric surface are considerably in excess of those amounts customarily applied to fabrics during conventional finishing treatments. In all events, the moisture applied is greater, usually significantly so, than the maximum amount of moisture that could be imparted by application of steam (about 2%, by weight) and/or by natural moisture regain with time (about 6% by weight). Because of the significant amounts of moisture to be applied, the area in the immediate region of the nozzle banks 40, 41 is laden with finely divided mist or fog, and special care must be taken to avoid the formation of droplets of moisture condensate at locations from which the droplets could fall under the fabric and form a water spot. To this end, the lower nozzle bank 41 and its supporting structure are arranged to be located entirely below the path of the fabric 16, so that any condensate formations merely drop to the bottom of the tank. Beneath the upper nozzle bank 40, there is provided a condensate shield 48, which extends from one side of the tank to the other and has a V-shaped collecting groove 49 inclined downwardly from the center thereof toward the opposite side walls 34, 35 of the tank. Any condensate falling from the nozzle bank 40 is caught by the shield 48 and drains down the inclined troughs 49 toward the tank side walls. Immediately adjacent to the walls, small gaps 50 are provided, enabling the collected water to drain down the sides of the tank. In this connection, the maximum width capacity of the fabric is somewhat less than the width of the tank, and typically corresponds to the width of the nozzle banks 40, 41, as reflected in FIG. 3, such that condensate guided off to the sides of the tank does not affect the fabric. In a similar manner, the front wall 36 of the tank may be provided with a condensate trough 51 above the entrance opening 24, so that any condensate forming on the inside front wall of the tank is collected and guided off to the sides.

Although the process of the invention is intended to be substantially continuous, inevitably there are many occasions that require temporary stoppage of the processing line for short times during normal operations. When such stoppages occur, it is of course necessary to immediately discontinue the application of moisture to the fabric surface to avoid excessive wetness. One way of achieving this is to shut off the supply of water to the nozzles. However, experience has shown that, whenever the nozzles are shut off and re-started, there is inherently some amount of sputtering of the nozzles. This can result in water spotting of the fabric, which is of course highly undesirable. Accordingly, pursuant to one aspect of the invention, instead of shutting off the nozzles during temporary process stoppages, the nozzle banks are muffled, whereby the nozzles are permitted to continue to discharge, but the atomized water is immediately trapped and drained away without contacting the fabric and without creating a misty atmosphere which could either condense on the fabric or on surfaces of the moisturizing chamber 23 in a manner to create a potential water spotting problem.

Pursuant to one aspect of the invention, both the upper and lower banks 40, 41 of atomizing nozzles are mounted for pivotal movement as by providing for limited rotational movement of the manifold pipes 43, 44, as reflected particularly in FIGS. 5 and 6. During a temporary stoppage in the processing line, the manifold pipes 43, 44 may be rotated in a direction to tilt the respective banks of nozzles 45, 46 downwardly behind shield plates 48, 51. Mounted on each of the shield plates is a muffle strip 52, 53 of porous sponge arranged either to extend in a continuous strip across the working width of the shield or in individual sections located in alignment with the respective nozzles 45, 46. The positioning of the sponge elements 52, 53 is such that, when the nozzle banks are retracted to the broken line positions shown in FIGS. 5 and 6, by rotation of the manifold pipes 43, 44, the nozzle tips depress the material of the sponge, permitting adjacent areas of the sponge to deform around and embrace the orifice area of the nozzle. Accordingly, as the atomizing nozzles continue to discharge atomized water, the discharge is emitted directly into the sponge muffle strips 52, 53. The atomized water is thus instantly condensed within the sponge, as it issues from the nozzle. Water of course accumulates within the sponge muffle elements 52, 53, but as soon as the sponges are saturated, the water flows from the bottom of the sponge, along the lower flanges of the shields 48, 51 and into the bottom of the collecting tank 33. When the process is resumed again, after a temporary stoppage, it is merely necessary to tilt the nozzle-mounting manifold pipes 43, 44 back to their normal positions, so that the atomized discharge from the nozzles is directed at the fabric surface. The described muffle arrangement also facilitates initial start up of the line, as the nozzle banks may be activated while in the retracted positions and operated briefly to clear the lines and nozzles to avoid sputtering on the fabric itself.

The system of the invention is uniquely advantageous in connection with the finish processing of mechanically compacted fabric, where it is desirable to restore surface characteristics of the fabric after the compressive shrinkage treatment. The process is primarily intended for and is useful to greatest advantage in connection with asymmetrical burnish compacting techiques, such as described herein, although it also has possible application in other finishing treatments in which the fabric surface is temporarily affected (as by crushing, for example).

A particularly significant aspect of the invention involves the application of the processed fabric of significant quantities of surface moisture, in an extremely finely divided, uniformly distributed state, free of discrete, large droplets or the like, that might cause water spotting, and in amounts significantly greater than is possible either through steaming operations or through natural moisture regain. The fabric, with its surfaces thus substantially moisturized is then conveyed through a stabilized drying process, during which the surface moisture is driven from the fabric while the fabric is maintained in a geometrically stable condition, as by being confined between a heated dryer drum and a tensioned conveyor belt. During the drying procedure, the surface-applied moisture on the fabric is vaporized, driven slowly through the confined fabric and then released to the atmosphere. During the relatively extended period in which the fabric is traveling in contact with the heated dryer drum (e.g., 15–25 seconds at typical processing speeds), the natural fibers of the fabric are fully penetrated with moisture. The resulting effect is to substantially restore the surface appearance of the fabric, where it has been burnished and/or crushed, without significantly affecting the mechanical preshrinking imparted to the fabric in the upstream stage of the process.

One of the important practical features of the new process is the ease with which it may be monitored and controlled in a typical plant operation. Generally, a limiting factor is the capacity of the Palmer-type dryer to drive off moisture applied during the moisturizing stage. Accordingly, for a given nominal linear speed of fabric movement (e.g., 14 meters per minute), the rate of moisture application from the nozzle banks 40, 41 is initially adjusted so that the nozzles apply as much moisture as can be removed by the dryer. Since the moisture application is essentially accomplished on a weight per unit area basis, this preliminary setup of the line is relatively independent of the character of the fabric being processed. In a practical embodiment of the processing line of the invention, utilizing a Palmer-type dryer with a drum of about 1.5 meters diameter, a proper balance of moisture application to drying capacity was realized with an application rate of about 2.5 ounces per square yard.

Having established an appropriate balance between rate of moisture application and drying capacity, the process may thereafter be governed almost exclusively by simply increasing or decreasing the rate of linear movement of the fabric through the processing line. By speeding up the linear movement of fabric, the amount of moisture application per unit of area is proportionately decreased, as is the time spent in the dryer phase. In general, as long as the fabric emerging from the discharge side of the dryer stage has an appearance of two sidedness or other surface characteristics sought to be eliminated, the operator can adjust the process by gradually reducing the rate of linear movement of the fabric until its appearance is within specifications. By thus slowing down the fabric, more moisture per unit of area is applied by the nozzle banks 40, 41, and correspondingly more time is spent on the dryer.

As can be well appreciated, different types of construction of the fabric will require individually different treatment in terms of required levels of moisture application. Likewise, some fabrics may be compressively preshrunk only to a relatively small degree (eg., 8–10%) while others may have substantially greater compressive shrinkage, all depending on a great variety of conditions and requirements in the mill. The process of the invention, however, easily accommodates the range of such variables, through the simple control of speeding up or slowing down the linear movement of the fabric through the moisturizing and drying stages. In all cases, the speed of operation of the compacting equipment is subserveint to the speed of operation of the moisturizing-drying stages. Most advantageously, this is accomplished by sensing the size of the fabric loop 22, between the compactor stage and the moisturizer stage, and appropriately increasing or decreasing the speed of the compactor stage.

In view of the substantial amounts of moisture applied to the fabric during the moisturizing stage, it is significant to maintain the fabric relaxed and quiescent during moisturizing and to maintain fabric geometry during drying. This is ideally accomplished through the use of misting type spray nozzles for moisture application and a Palmer-type dryer for the drying stage. Because the fabric has been compressively preshrunk longitudinally prior to moisturizing, it is significant to the process that the moisture application be in the form of surface application rather than complete impregnation of the fabric, so that the fabric does not lose its geometric integrity while it is unsupported. After the fabric is engaged by the Palmer-type dryer and is geometrically stabilized, the moisture can fully penetrate the fabric without adversely affecting the mechanical compacting.

The spray chamber arrangement described herein has been found to be particularly advantageous for the purposes intended, enabling significantly high amounts of moisture to be applied to the surface of the fabric, while avoiding condensation and spotting problems, and while simultaneously maintaining the fabric in a properly relaxed and quiescent state. In the illustrated arrangement, the fabric enters the open top chamber in the lower front portion, and is guided upwardly, to exit from the chamber in the upper rear portion thereof. The upwardly inclined path of travel through the spray chamber enables the nozzle banks to be conveniently and effectively located both with reference to spray application effectiveness and with respect to avoidance of condensation and drip problems. At the same time, the upwardly inclined path of travel of the fabric is advantageous from the standpoint of minimizing stress on the fabric which, when it emerges from the moisturizing zone, is both moist on its surface and laden with the weight of the moisture, so as to be particularly vulnerable to longitudinal strains. To this end, in addition, the moisturizing chamber is closely coupled with the Palmer-type dryer. Indeed, the exit guide roller for the moisturizing chamber is the entry belt guide roller to the Palmer-type dryer, so that the fabric is physically supported immediately upon its emergence from the moisturizing zone.

The process of the invention is applicable to a wide variety of fabrics, of both knitted and non-knitted constructions and of both tubular and non-tubular configuration, provided the fabric has sufficient natural or other hydrophilic fiber content to enable it respond to the application of moisture. The process is, of course, extremely advantageous in connection with the finish processing of tubular knitted fabrics, where a relatively high percentage of burnish compacting may be applied to the fabric in a first phase of its finishprocessing and where uniformity of surface appearance on the top and bottom of the tubular knitted fabric web is of particular significance, inasmuch as the top and bottom constitute the same surface.

In general, the production capacity of available burnish compacting equipment is significantly greater than the linear output capacity of a Palmer-type dryer of practical size and configuration. Accordingly, overall production efficiencies may be improved in many instances by performing the burnish compacting operations separately, rather than in line with the drying operation. In such cases, the compacted may be folded or otherwise gathered in a tension free condition at the discharge end of the compacting equipment. In a separate operation, two or more webs of compacted fabric may be conveyed simultaneously through a common apparatus, to carry out the moisturizing and drying sequence as described herein. Such an arrangement may be particularly advantageous where the compacted web is relatively narrow and/or where the moisturizing-drying treatment of the fabric requires a relatively low linear rate of travel through the dryer for optimum conditioning.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A process for the finish treatment of knitted fabrics containing at least some proportion of hydrophilic fibers, which comprises (a) mechanically compressively shrinking the fabric longitudinally by an asymmetrical compressive shrinkage process whereby opposite sides of the fabric differ in appearance, (b) supplying the compressively shrunk fabric to a moisturizing zone and advancing the fabric through said zone, (c) applying moisture in the form of a finely-divided mist to the fabric from opposite sides thereof, during its passage through said zone, at a rate which will add substantially more moisture by weight to the fabric than the potential moisture regain in time for the fabric and in the range of from more than about 6% up to about 50% moisture by weight, and (d) immediately thereafter supporting and confining said fabric in a heating and drying zone, to effect full penetration of the fabric by said applied moisture and to effect drying of the fabric while maintaining the fabric geometrically stabilized whereby significantly improved fabric surface characteristics are achieved through minimization of the two-sidedness in appearance.

2. The process of claim 1, further characterized by
(a) said fabric being a tubular knitted fabric.

3. The process of claim 1, further characterized by
(a) said moisturizing being applied at a constant rate per unit of time, and
(b) the amount of moisture applied to the fabric being controlled by varying the speed of advance of the fabric through the moisturizing zone.

4. The process of claim 3, further characterized by
(a) said fabric being advanced through said drying zone and said moisturizing zone at the same variable speed.

5. The process of conditioning previously mechanically longitudinally shrunk fabric of knitted construction having at least some proportion of hydrophilic fibers and having opposite side surfaces with differing appearances by reason of said longitudinal shrinking, which comprises
(a) advancing said fabric in a relaxed and quiescent state through a moisturizing zone,
(b) in said moisturizing zone, spraying said fabric with an extremely finely divided mist to apply moisture in amounts substantially greater than the potential natural moisture regain with time of the fabric and in the range of from more than about 6% to about 50% moisture by weight, and
(c) drying said fabric by conveying the fabric through a drying zone while supporting and confining the fabric whereby significantly improved fabric surface characteristics are achieved through minimization of the two-sidedness in appearance.

6. The process of claim 5, further characterized by
(a) said fabric being sprayed on both surfaces with said finely divided mist, and
(b) said fabric being guided in a tension free condition through a generally upwardly inclined course through said moisturizing zone.

7. The process of claim 5, further characterized by
(a) said fabric being conveyed at the same speed through said moisturizing and drying zones,
(b) said mist being sprayed at a constant rate, and
(c) the speed of travel of said fabric being controllably adjusted to control the amount of moisture applied to the fabric.

8. The process of claim 7, further characterized by
(a) said fabric being mechanically longitudinally shrunk on an in-line basis with the moisturizing and drying operations, and
(b) the speed of operation of the longitudinal shrinking operation being subserviently controlled with respect to the speed of travel of the fabric during the moisturizing and drying stages.

9. The process of claim 5, further characterized by
(a) said fabric being supported across its entire width immediately following and in close coupled relation to the moisturizing stage.

10. The process of claim 9, further characterized by
(a) said drying stage being carried out by confining the moisturized fabric tightly against a moving heated surface.

11. The process of claim 10, further characterized by
(a) the period of confinement of said fabric during said drying stage being controllable and variable in direct proportion to the amount of moisture applied to said fabric.

12. The process of claim 11, further characterized by
(a) the amount of moisture applied to said fabric being controllably variable by (i) fixing the rate per unit of time of application of moisture and (ii) varying the speed of travel of said fabric.

13. The process of claim 5, further characterized by
(a) two or more webs of said fabric being processed simultaneously and in side-by-side relation.

14. The process of finish treating knitted fabric containing at least some proportion of hydrophilic fiber, which comprises
(a) longitudinally mechanically compressively shrinking the fabric by an asymmetrical compressive shrinkage process.
(b) immediately thereafter applying a finely divided mist to the surface of the fabric while conveying the fabric in a relaxed, quiescent manner to add substantially more moisture to the fabric than amounts of moisture regainable through natural moisture regain with time for the fabrics and in the range of from more than about 6% to about 50% moisture by weight,
(c) immediately thereafter supporting and confining the fabric and drying the fabric by driving off said moisture,
(d) controllably adjusting the speed of travel of the fabric during moisturizing and drying phases, whereby to control the amount of moisture application per unit of fabric area, and
(e) controlling the speed of travel of the fabric through the compressive shrinkage phase, whereby to deliver fabric free of tension to the moisturizing phase whereby significantly improved fabric surface characteristics are achieved through minimization of two-sidedness in appearance imparted thereto by reason of said longitudinal compressive shrinkage.

15. The process of claim 14, further characterized by
(a) manually controlling the speed of advance of the fabric through the moisturizing and drying phases in accordance with the observed condition of the fabric, and
(b) automatically controlling the speed of advance of the fabric through the compressive shrinkage stage in accordance with the condition of a fabric loop between the compressive shrinkage stage and moisturizing stage.

16. A process for the finish treating of knitted fabrics having at least some proportion of hydrophilic fiber, which comprises
(a) mechanically compressively shrinking a plurality of webs of knitted fabric in separate operations, and
(b) simultaneously processing two or more of such webs in side-by-side relation by applying extremely finely atomized moisture to the opposite sides of the webs in amounts sufficient to add substantially more than the potential natural moisture regain of the fabric and in the range of from more than about 6% to about 50% moisture by weight and immediately thereafter drying said webs while supporting and confining said webs in side-by-side relation by a common conveying means whereby significantly improved fabric surface characteristics are achieved through minimization of two-sidedness in appearance imparted thereto by reason of said compressive shrinking.

* * * * *